US005624120A

United States Patent [19]

Frank-Opigo

[11] Patent Number: 5,624,120

[45] Date of Patent: Apr. 29, 1997

[54] U.S. PRESIDENTIAL CAMPAIGN AND ELECTION GAME

[76] Inventor: Emmanuel A. Frank-Opigo, P.O. Box 550, Port Harcourt, Nigeria

[21] Appl. No.: 540,490

[22] Filed: Oct. 10, 1995

[51] Int. Cl.[6] ..... A63F 3/00

[52] U.S. Cl. ..... 273/279

[58] Field of Search ..... 273/242, 243, 273/248, 249, 257, 279

[56] References Cited

U.S. PATENT DOCUMENTS

| | | | |
|---|---|---|---|
| 753,949 | 3/1904 | Wing | 273/279 |
| 1,616,216 | 2/1927 | Dempsey | 273/279 |
| 2,043,482 | 6/1936 | Lord | 273/257 |
| 3,368,816 | 2/1968 | Milazzo et al. | 273/257 |
| 3,512,779 | 5/1970 | McGaughey | 273/279 |
| 4,092,028 | 5/1978 | Marse | 273/257 X |
| 4,299,390 | 11/1981 | Delgado | 273/257 |

FOREIGN PATENT DOCUMENTS

| | | | |
|---|---|---|---|
| 437091 | 6/1948 | Italy | 273/257 |

*Primary Examiner*—William E. Stoll

[57] ABSTRACT

The present invention entails a game and a game board apparatus. The game board apparatus comprises a game board, a pack of fifty-one playing cards and two normal six-sided dice. The game board is ruled into eighty-eight squares made up of eleven columns labelled A to K and eight rows within the confines of which fifty-one squares represent America's fifty states and the District of Columbia. The states, this term to include the District of Columbia whenever not specified, are so arranged that the boundaries approximate the map of the United States. On each of the fifty squares is written the name of the state and the state's electoral vote. The fifty-one cards have the same information as on the squares, but in addition also display the flag of the state, the letter indicating the state's location, that is any of the letters A through K, and the state's Trump Number, which is an indication of the relative ease with which that state can be won. The game is played by two persons designated the presidential candidates of the Democratic and Republican Parties. The game simulates the United States' presidential election system. Play involves contesting and contriving to win the Electoral College votes from three groups of states, namely, the locked states, the swing states and even sometimes the so-called lost states. The objective of the game is to be the first to win at least two hundred and seventy Electoral College votes.

2 Claims, 3 Drawing Sheets

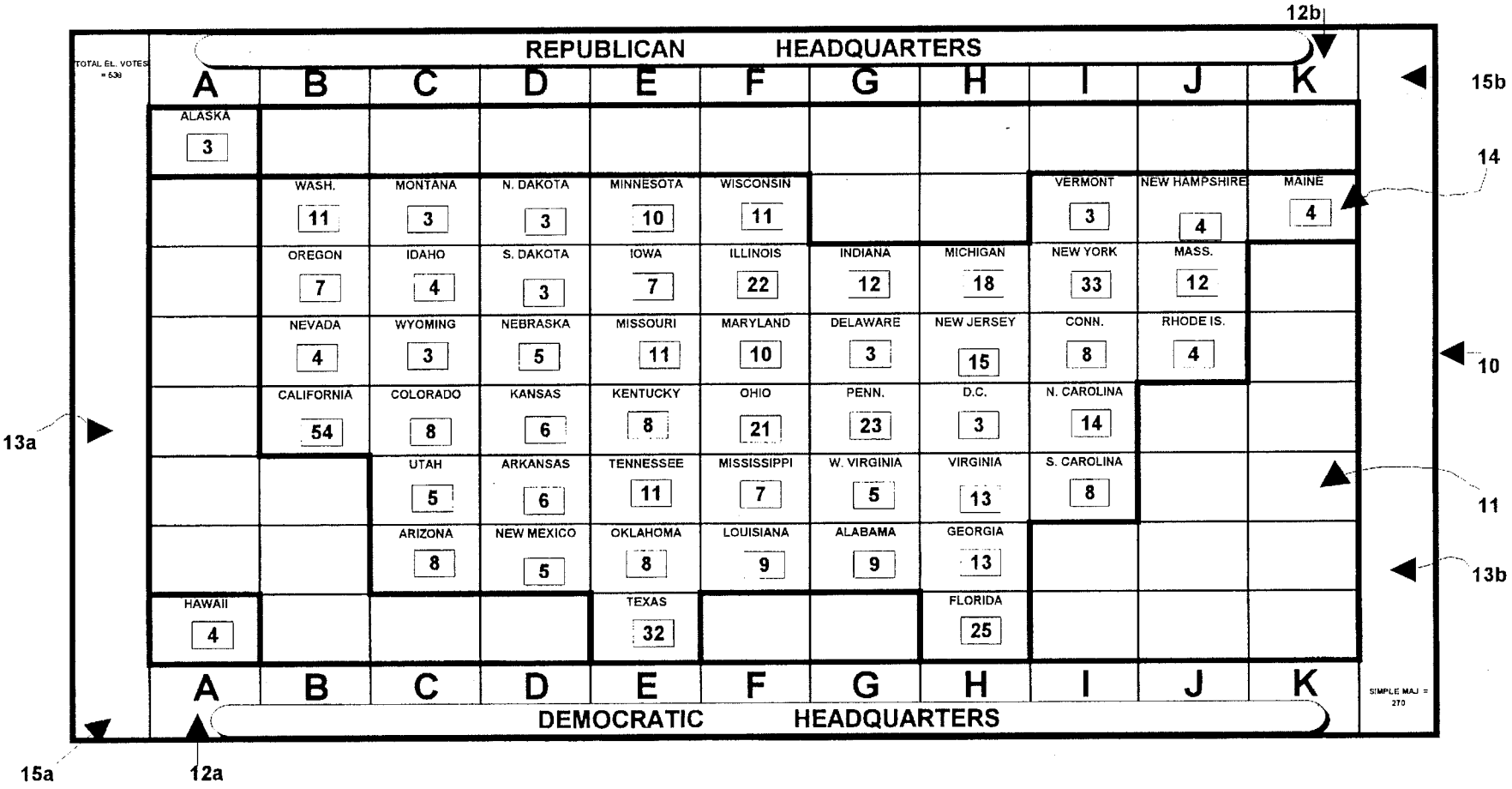
FIGURE 1: Game Playing Board (Two Six-sided Dice)

(Typical Trump Card)

| ZONE | STATE | ELECTORAL VOTE | TRUMP NUMBER |
|---|---|---|---|
| A | ALASKA | 4 | 6 |
| | HAWAII | 5 | 6 |
| B | NEVADA | 4 | 6 |
| | OREGON | 7 | 7 |
| | WASHINGTON | 11 | 8 |
| | CALIFORNIA | 54 | 12 |
| C | MONTANA | 3 | 6 |
| | WYOMING | 3 | 6 |
| | IDAHO | 4 | 6 |
| | UTAH | 5 | 6 |
| | ARIZONA | 8 | 7 |
| | COLORADO | 8 | 7 |
| D | NORTH DAKOTA | 3 | 6 |
| | SOUTH DAKOTA | 3 | 6 |
| | NEBRASKA | 5 | 6 |
| | NEW MEXICO | 5 | 6 |
| | ARKANSAS | 6 | 7 |
| | KANSAS | 6 | 7 |
| E | IOWA | 7 | 7 |
| | KENTUCKY | 8 | 7 |
| | OKLAHOMA | 8 | 7 |
| | MINNESOTA | 10 | 7 |
| | MISSOURI | 11 | 8 |
| | TENNESSEE | 11 | 8 |
| | TEXAS | 32 | 11 |

| ZONE | STATE | ELECTORAL VOTE | TRUMP NUMBER |
|---|---|---|---|
| F | MISSISSIPPI | 7 | 7 |
| | LOUSIANA | 9 | 7 |
| | MARYLAND | 10 | 7 |
| | WISCONSIN | 11 | 8 |
| | OHIO | 21 | 10 |
| | ILLINOIS | 22 | 10 |
| G | DELAWARE | 3 | 6 |
| | WEST VIRGINIA | 5 | 6 |
| | ALABAMA | 9 | 7 |
| | INDIANA | 12 | 8 |
| | PENNSYLVANIA | 23 | 10 |
| H | D.C. | 3 | 6 |
| | GEORGIA | 13 | 8 |
| | VIRGINIA | 13 | 8 |
| | NEW JERSEY | 15 | 8 |
| | MICHIGAN | 18 | 9 |
| | FLORIDA | 25 | 10 |
| I | VERMONT | 3 | 6 |
| | CONNECTICUT | 8 | 7 |
| | SOUTH CAROLINA | 8 | 7 |
| | NORTH CAROLINA | 14 | 8 |
| | NEW YORK | 33 | 11 |
| J | NEW HAMPSHIRE | 4 | 6 |
| | RHODE ISLAND | 4 | 6 |
| | MASSACHUSETTS | 12 | 8 |
| K | MAINE | 4 | 6 |

FIGURE 4: Allocation of "Trump Numbers"

U.S. PRESIDENTIAL CAMPAIGN AND ELECTION GAME

FIELD OF INVENTION

The present invention relates to games and game board apparatuses. In particular it relates to a game simulating the United States presidential election system in which presidential candidates contrive to win a simple majority (270) of the 538 electoral votes being contested.

BACKGROUND OF THE INVENTION

Board games that simulate real life situations are exciting because the players can identify with the motifs. A few board games based on the United States' Presidential Election System have been devised, but nothing really definitive and enduring as applicable in some other areas of board games has been invented.

In an attempt to simulate exactly the real life situation, many of the games of the prior art consist of too much detail and accessories. The result is methods of playing that are too cumbersome and therefore detract from the fun of playing, which should be the overriding goal of a game. The educational merit of a game can only be sustained if it gives the players a minimum of stress, makes them want to play it again and again in quick succession, and inspires them to discover more (the real educational value) beyond the synopsis presented in the game. Hence the need for an inspirational election game that could be easily comprehended and played by all ages.

The U.S. system offers exciting possibilities because of its peculiar and enduring nature. The present invention achieves simplicity, in the first instance, by having a minimum of accessories, viz: a playing board, 51 cards, two normal dice and a set of delicately contrived but simple rules blending luck and strategy Also, the accessories (51 cards) are all placed on the game board at the beginning of the game and dissipate as the game progresses, rather than accumulate and clog the game board as in most games of the prior art.

Educational information such as results of previous presidential elections are included separately as an appendage, while the flags of the states are printed on the respective cards.

SUMMARY OF THE INVENTION

The present invention therefore entails an optimised U.S. presidential campaign and election game which simulates the electoral process with a minimum of apparatuses, stimulates the imagination of the players by minimising distractions (cumbersome recording of every detail, moving and removing of too many accessories, etc.) and emphasises an old cliché—with: political elections are simply a game of numbers. In the present invention the "numbers" refer, not just to the Electoral College votes being contested, but equally to two other important numbers—state "Trump Numbers" and popular vote "Percentages"—both of which are obtained by variously combining the numbers rolled on the two dice.

In the U.S. presidential election system the crucial number of questions is 538. This is the total of all electoral college votes of the fifty states and the District of Columbia (the capital territory). Half of this number is 269, and therefore a candidate requires a simple majority of 270 electoral votes to win the presidency.

To win the electoral college votes in a state, a candidate has to win the popular vote in that state. (Note that it is possible, by winning some states with small margins and losing others with large margins, for a candidate to lose the popular vote nationally and yet win the Electoral College vote and the Presidency, as Rutherford B. Hayes did in 1876 and Benjamin Harrison in 1888).

This present invention recognises that during the campaign and even by Election Day there are usually three main "blocs" of states, namely: (i) "Locked" states where the polls predict victory for the candidate; (ii) "Lost" states where the polls predict victory for the opponent and (iii) "Swing" states where there is a large number of undecided voters. Thus the 51 cards are divided into three equal parts of 17 cards each at the outset to represent these recurring groups.

In real presidential elections there are often more than two candidates, but usually two main candidates, representing the two main parties (the Democratic and Republican Parties). The present invention restricts the field to two candidates as this is essential in the simulation to ensure that victory is obtained by acquiring 270—and not simply the most—Electoral College votes. However, the imagination easily includes "unseen" independents and third parties as "also-rans" sharing in the yet undetermined vote (popular and electoral) left over at the point of conclusion of the game, which is when one player has won at least 270 electoral votes.

In order to achieve a more functional game board, the present invention transcribes the map of the United States onto a chequer board of sorts with clear reference co-ordinates. An approximate outline of the map of the United States is maintained with a "best fit" arrangement of states. Because of the clustering of states on the East Coast in the real map, there is an inevitable aberration resulting from giving equal space to each state. But since the goal is to achieve an optimally functional game, this can be accommodated. The states are now zoned according to columns (labelled A through K) and within each zone a "tug-of-war" element is introduced in the rules of play Other objects, advantages and features of the present invention will become hereinafter apparent by reference to the following detailed description of the invention and the accompanying drawings which are merely illustrative of the invention.

BRIEF DESCRIPTION OF THE DRAWINGS

FIG.1 is a plan view of the game board of the present invention, showing the states represented by squares so arranged as to approximate the political map of the United States. The game board may be made of cardboard or other firm material. Three or more colours are used for the different segments of the drawing to make it attractive.

FIG. 4 is a table showing the allocation of "Trump Numbers" to the fifty states and the District of Columbia.

DETAILED DESCRIPTION OF THE INVENTION

With reference to the drawings wherein parts described are referenced by numerals, FIG. 1 shows a game board 10 having an inner rectangular area 11, comprising eight rows and eleven columns. Within these eighty-eight squares, fifty-one squares 14 represent the fifty states of America and the District of Columbia. The squares representing the states are so chosen that the outline approximates the map of the United States. The inner rectangle 11 is bounded above and below by squares 12*a*, 12*b* marked serially A through K, used in identifying the eleven columns of the inner rectangle and designated "Democratic Headquarters" and "Republican Headquarters" respectively. The inner rectangle 11 is bounded on the left and right by two strips 13*a*, 13*b* reserved for inscribing the trademarks of the game. The squares 15*a*, 15*b* are for imprinting the symbols of the respective parties (that is, a horse for the Democrats and an elephant for the Republicans).

Figure 3:
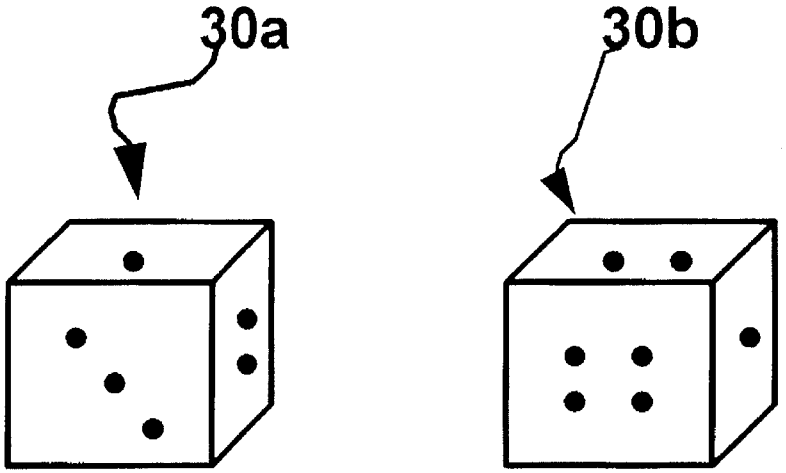
FIG. 3 is an isometric view of two normal dice with six sides, conventionally numbered 1, 2, 3, 4, 5 and 6 and used in the present invention. The dice may be made from wood or synthetic material.
Figure 2:
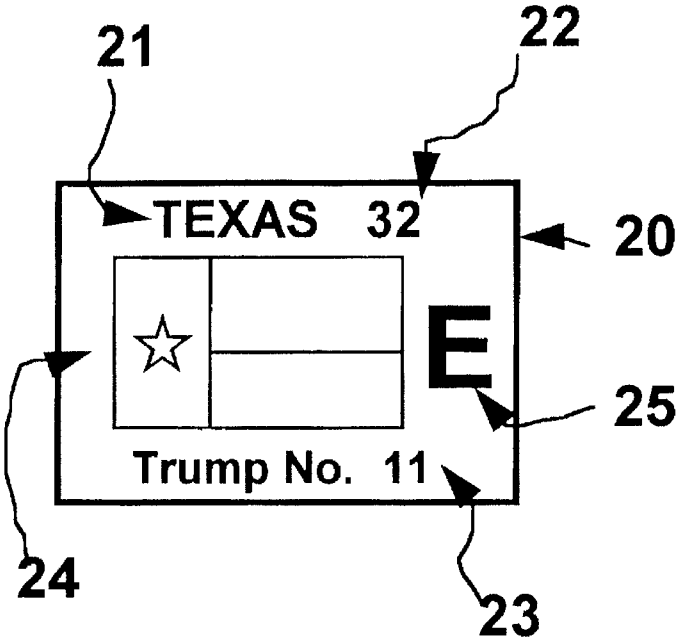
FIG. 2 is a plan view of a typical "trump card" of the present invention indicating (i) the name of the state: (ii) the state's Electoral Vote, (iii) the state's "Trump Number" described subsequently and (4) the state's Flag. There are 51 such cards representing the 50 states and the District of Columbia. The cards may be made from firm paper and again colours are so chosen as to make the cards attractive. The flags of the states will be given their natural colours.

For the purpose of the present invention, the states are zoned according to the columns (A–K) 12*a*, 12*b* in which they are located. Within the zone, each state 14 is given a Trump Number 23 which is written on the state's trump card 20 (FIG. 2) and is determined as follows:

When the two dice 30*a*, 30*b* are rolled a total of twelve numbers (1 through 12) can be obtained, taking the numbers both singly and jointly. Hence the following frequency of numbers (number of possible ways of obtaining the numbers 1–12) is established:

| Number rolled on one and/or two dice | Frequencies |
|---|---|
| 1 | 2 |
| 2 | 3 |
| 3 | 4 |
| 4 | 5 |
| 5 | 6 |
| 6 | 7 |
| 7 | 6 |
| 8 | 5 |
| 9 | 4 |
| 10 | 3 |
| 11 | 2 |
| 12 | 1 |

The numbers (6) through (12) are designated "Trump Numbers" and represent the key differentiating functional element between the present invention and games of the prior art.

The fifty states and the District of Columbia are assigned trump numbers with frequencies varying inversely with their Electoral College votes, thus:

| Electoral Vote Range | Trump Number |
|---|---|
| 1–5 | 6 |
| 6–10 | 7 |
| 11–15 | 8 |
| 16–20 | 9 |
| 21–30 | 10 |
| 31–40 | 11 |
| 41 and above | 12 |

A detailed allocation of Trump Numbers is given in Figure 4.

The graded assignment of trump numbers makes it naturally more difficult to win states with high Electoral College votes. For instance, California, with a staggering Electoral College vote of (54) (representing a full 20% of the 270 required to win) is allocated a trump number of (12) with frequency (1), which means it can only be won (if a locked state) or accessed (if a swing state) with a roll of two sixes on the dice (see Method of Play). This can happen in only one way, as indicated in the table above, and therefore California (like New York and Texas with trump numbers of 11) is likely to be hotly contested in almost every game irrespective of whether it starts off as a locked or swing state, especially in view of the rule allowing states to become unlocked or "released" and described in Rule (8) under "Method of Play" below.

On each state's square 14 on the map is written the name of the state and the state's Electoral College vote. On the fifty-one trump cards 20 are written the name of the state 21, the state's electoral vote 22, the state's trump number 23, and the letter indicating the state's zone 25. In addition, the state's flag 24 is printed on the card. The two dice 30*a*, 30*b* are the "energizers" that set the game in motion. The game is played by the method set out hereunder.

Method of Play

1) The players toss with the dice 30*a*, 30*b* to determine who is the Incumbent President and who is the challenger.
2) The player who wins the toss (higher sum) is the Incumbent. He shall (a) choose which Party to play and (b) play first. The other player is the Challenger.
3) The trump cards 20 are shuffled, face down and shared into three equal parts (having seventeen cards each). The Incumbent takes one set of cards, and the Challenger another. Each Candidate is now in possession of seventeen states in which he is a clear front runner in the opinion polls ("locked" states). The remaining seventeen states are "swing" states that may vote either way.
4) The players may now sum up their total electoral votes 22 in the "Opinion Polls" (the sum of the votes of their seventeen "locked" states). This will help each player plan his strategy as it will be clear who the overall "front runner" is. Also, it is always interesting to know whether or not the eventual victory was an upset.
5) Each player will place his trump cards 20 face up on their appropriate squares marked (A–K). The cards on each file are further arranged in ascending order of "electoral strength", that is, the state with the least electoral votes 22 on that file is placed topmost. The "swing" states are placed on their respective squares on the U.S. "map" 14.
6) The election proceeds with the players rolling the dice 30*a*, 30*b* alternately, starting with the Incumbent. If the sum of the numbers rolled corresponds with any of the player's trump numbers 23 on the topmost trump cards 20, the player wins (sweeps) all such corresponding "locked" states simultaneously. The trump card 20 for any state won is kept by the player and the Electoral Vote score 22 is recorded for him. If a roll of the dice produces no score, the player simply passes the turn. A player can only win the "on" state (topmost card) on a file. The next card only becomes "on" on the next burn. Also, the swing states on any file are not "on" for a player until the next turn after his last "locked" state on that file has been won (see below).
7) Once a player exhausts his cards on any file (A–K) 12*a*, 12*b*, he is now free to concentrate his "campaign forces" on the swing states along that file (if any). All the swing states along the file are then "on" simultaneously. Once the player obtains the corresponding Trump Number 23 and declares he wants to "contest" the swing state, the contest is carried out in the following manner. The player who has just "arrived" the state will roll the dice 30*a*, 30*b* to see his latest rating in the polls in that state 14. The numbers on the dice are read as the two digits of a percentage (bigger number first). If he scores greater than 50% (that is, one of the two numbers thrown is 5 or 6), he wins the state. If he scores less than 50% on his first attempt, he rolls the dice again so long as he keeps improving on his earlier percentage. If at any point he obtains less than the immediate last percentage or stagnates (same percentage as last), he loses his campaign "initiative" in that state and the opportunity passes to his opponent who repeats the process. This process may go back and forth until one player scores over 50% and wins the state 14. Swing states cannot be "swept", hence only one swing state can be resolved at a time irrespective of how many trump numbers correspond with the number rolled.

8) When a player exhausts all his cards on a file (A–K) 12*a*, 12*b* and the swing states along the file are also all taken, he now concentrates his campaign forces on that file on his opponent's "locked" states in a bid to turn the tables. The opponent's "on" state along the file (topmost card) is automatically "released" once that situation exists and becomes a swing state. It is placed on the "map" like other swing states. Once it is won by either player, the next card on that file comes out likewise as a swing state. Notice that MAINE is a swing state at the start of every game!

9) A cumulative score of votes won is kept by a scorer. If no scorer is available, both players keep score as a check. Note that in scoring it is not necessary to record the names of states won as the player keeps the corresponding card. This is another "distraction" that is avoided during play.

10) The first player to score a cumulative of two hundred and seventy electoral votes wins the game. (This is a simple majority of the total of five hundred and thirty-eight).

The preferred embodiment of the present invention as described above and illustrated by the appended drawings, is merely illustrative and not exclusive, as will be apparent to those skilled in this field of invention. For instance: (a) the arrangement of states can be altered to give a different "fit"; (b) the Electoral College votes can be replaced with appropriate party delegate votes to produce a party nomination variant of the game; (c) the Trump Cards can be replaced with tiles and drawn from a bag and (d) the game could be adapted for and played on computer. These and other possible variations can be made without departing from the spirit and specific idea of the present invention. Hence all equivalent variations based on similar methods and motifs described in this specification, are deemed to be embraced herein.

What I claim is:

1. A game board apparatus for playing a United States Presidential election game comprising two six-sided dice, a playing board with the fifty states and the District of Columbia arranged in grids or zones and approximately outlining the map of the United States, fifty-one playing cards designated Trump Cards, each inscribed with the state's name, Electoral College vote, one of the letters A to K designating the zone in which the state is located and a number designated the Trump Number which is obtained from the sum of the numbers rolled on the two dice, such numbers assigned in inverse proportion of frequency to the state's Electoral College vote in a given zone.

2. A method of playing a board game based on the United States Presidential election system comprising two six-sided dice, a playing board with the fifty states and the District of Columbia arranged in grids or zones and approximately outlining the map of the United States, fifty-one playing cards designated Trump Cards, each inscribed with the state's name, Electoral College vote, one of the letters A to K designating the zone in which the state is located and a number designated the Trump Number which is obtained from the sum of the numbers rolled on the two dice, such numbers assigned in inverse proportion of frequency to the state's Electoral College vote in a given zone, such method of play comprising the steps of rolling the two dice to determine who starts, the player with the higher sum rolled playing first, division of the fifty-one playing cards designated Trump Cards into three equal groups of seventeen cards each, each player taking possession of one group, the states in each player's group being considered locked states, meaning virtually certain to vote for that player, the states in the third group of seventeen cards being swing states that might vote either way, placing each player's locked states face up on their respective starting squares marked A to K, separately designated Democratic and Republican Headquarters and further arranging the cards on each square A through K in ascending order of Electoral College vote strength, the least state being topmost, placing the Trump Cards for the swing states on their respective state squares on the game board which is the approximated map of the United States, the players rolling the dice in turn and each player winning his locked states simply by rolling the corresponding Trump Number of any of the topmost cards, simultaneously winning on the same turn all such topmost cards currently displayed that have the corresponding Trump Number, contesting swing states during a particular turn by first rolling the corresponding Trump Number to access the state, then rolling the dice as part of the same turn and reading the numbers rolled on the dice not as a sum this time but as the digits of a percentage of the popular vote, the larger digit being read as the first digit in the percentage, that player winning the swing state if he scores over fifty percent on his first or subsequent attempts, such subsequent attempts being made consecutively without passing the turn to the opponent until and unless he scores a percentage less than or merely equal to the percentage rolled during his last attempt, the opponent now in turn rolling the dice for percentage scores in the same state using the same procedure just described, and this process going back and forth until one player scores over fifty percent of the popular vote and wins the swing state, a player's topmost locked state being released as a swing state once the other player's locked states as well as the intervening swing states have all been won, play continuing with either locked or swing states depending on the numbers rolled on the dice and the choice of the player with the turn whether to win any corresponding locked states or to contest any corresponding swing states, keeping a tally of the cumulative totals of Electoral College votes won by each player and concluding the game once one player wins at least two hundred and seventy Electoral College votes and therefore wins the game by virtue of having won a simple majority of Electoral College votes.

* * * * *